United States Patent [19]

Ford

[11] Patent Number: 4,651,376

[45] Date of Patent: Mar. 24, 1987

[54] UNDERWATER SELF-CONTAINED CLEANING ASSEMBLY

[76] Inventor: Ralph W. Ford, 10241 S.W. 102 Terrace, Miami, Fla. 33176

[21] Appl. No.: 784,018

[22] Filed: Oct. 4, 1985

[51] Int. Cl.[4] ..... E04H 3/20

[52] U.S. Cl. ..... 15/1.7; 15/347; 15/415 A

[58] Field of Search ..... 15/1.7, 347, 418, 415 A; 210/169

[56] References Cited

U.S. PATENT DOCUMENTS

| | | | |
|---|---|---|---|
| 3,551,930 | 1/1971 | Myers | 15/1.7 |
| 3,755,843 | 9/1973 | Goertzen et al. | 15/1.7 |
| 4,154,680 | 5/1979 | Sommer | 15/1.7 |

FOREIGN PATENT DOCUMENTS

| | | | |
|---|---|---|---|
| 216214 | 10/1967 | Sweden | 15/1.7 |
| 1152277 | 5/1969 | United Kingdom | 15/1.7 |

*Primary Examiner*—Edward L. Roberts
*Attorney, Agent, or Firm*—John C. Malloy

[57] ABSTRACT

A cleaning assembly to be used underwater primarily for the cleaning by removing of debris from bottom and wall surfaces of swimming pools, spas, and like water containing structures. A movable carriage supports a pump assembly which includes an impeller driven by a water sealed motor which in turn is powered by a water sealed battery or like electrical power source self-contained on the carriage. The impeller communicates directly with an input and output portion of a water channeling conduit so as to force water and debris carried thereby through the conduit, beyond the pump and eventually to a filter structure located on the exterior of the carriage. The filter structure is porous and therefore allows return of water directly to the pool while retaining debris which is removed from the bottom or wall surfaces of the pool.

15 Claims, 5 Drawing Figures

UNDERWATER SELF-CONTAINED CLEANING ASSEMBLY

BACKGROUND OF THE INVENTION

1. Field of the Invention

This invention relates to a cleaning assembly generally in the form of an underwater vacuum used to clean the submerged surfaces of pools, spas, etc. and which is particularly structured to be self-contained in terms of creating a filter force fluid flow for the collection of debris without relying on the pumping or filtering system permanently associated with conventional swimming pools or spas. The filter contained on the subject assembly is removable, washable and replaceable to save expense and time over conventional pool cleaning assemblies.

2. Description of the Prior Art

The use of various types of pool vacuums or cleaning assemblies to remove debris and dirt from the bottom and wall surfaces of a swimming pool are quite well known in the prior art. Typically, such systems incorporate a vacuum head, mounted on a wheeled carriage secured to an elongated pole for passing over the submerged surfaces of the pool. The vacuum head is generally secured in fluid communication to one end of an elongated flexible hose. The opposite end of the hose is normally connected to the filtering system built into the swimming pool. In such a prior art system, collected debris is passed through the fixed or permanent filter associated with the swimming pool and collected therein. Backwashing or other substantially conventional techniques are then required to clean the filtering system.

Differing from the above prior art systems are pool cleaning systems which use a self-powered pump. The pump is submerged and mounted on a housing or movable base which passes over the surface to be cleaned. Other prior art systems include "self cleaning" units which continuously roam the submerged surfaces of the pool and are generally powered by fluid action of the filtered water. While operable, the latter systems are generally complicated, expensive and have an overall disturbing effect on the appearance of the pool due to their constant motion.

The U.S. Pat. Nos. 3,755,843 to Goertzen; 3,886,616, Hayes; 4,168,557, Rasch ; and 3,439,368, Myers are generally representative of certain types of prior art pool cleaning systems are generally outlined above.

Of the above, the patent to Goertzen is primarily directed to a self-contained unit which is powered by a d.c. power source, such as an automobile battery or the like. An electric drive motor powers a pump which draws fluid and entrained debris through a filtering system or cannister located downstream of the pump assembly. Again, while operable, certain disadvantages may be considered to be associated with such a system relating to its compactness, efficiency and bulkiness.

Based on the above, there is an obvioius need in the prior art for a self-contained pool system which is structured in part to be water tight and therefore totally submergeable and further structured to have sufficient versatility to be maneuvered by hand to clean relatively shallow submerged surfaces, such as in a spa. Also, the unit is attachable to an elongated pole for cleaning relatively deep submerged surfaces and wherein the filtering system associated with the swimming pool is not needed. Other preferred advantages of such a system would be a removable, washable and replaceable filter and direct return of the filtered water immediately after filtering or removal of the debris therefrom. In addition, such a preferred assembly should be lightweight in construction, durable, effective to operate and adequately powered and structured to clean normally collected debris from the submerged surfaces in a minimal amount of time.

SUMMARY OF THE INVENTION

This invention relates to a pool cleaning assembly of the type which is self-contained and structured to be entirely submersible so as to clean submerged surfaces of dirt and accumulated debris normally associated with swimming pools, spas and like water containing structures. The subject assembly includes a wheeled carriage capable of being maneuvered over the submerged surfaces by a handle means. The handle means includes a first handle portion which may be fixedly secured to the carriage and specifically configured and dimensioned to be gripped by the hand of the user. Such handle is used for the cleaning of relatively shallow, submerged surfaces such as in a spa. Also, the handle means includes a movable ball and socket type handle connector for removable attachment to one end of an elongated pole. Such poles are commonly used in swimming pool cleaning assemblies and by virtue of this connection, the carriage may be maneuvered across the submerged surfaces at relatively great depths.

The carriage includes a pump means mounted thereon for forcing water or fluid flow from the exterior of the carriage, through a channeling nozzle, to the exterior of the carriage through a removalbe filter structure secured downstream of the pump assembly at one end of an exteriorly located channeling conduit. The filter assembly may be readily removed from this channeling conduit and cleaned of debris collected from the filtered water. The filter structure is then readily replaced so as to alleviate the need for expensive replacement filters which are difficult or impossible to clean. The pump assembly includes a rotatable impeller commonly known as a voluted impeller disposed in fluid communication between an inlet conduit and an outlet conduit so as to force waterflow therebetween.

The impeller is rotatably driven by a drive motor which is mounted on the carriage within a water tight or waterproof housing. Similarly, a power source in the form of a d.c. battery or alternately a nickel candium battery which may be recharged periodically between operations is electrically interconnected to the drive motor so as to selectively activate the drive motor by an on/off switch assembly. The battery is housed in a water tight manner, similar to the drive motor so as to prevent damage thereto when the entire carriage is submerged.

Accordingly, the subject cleaning assembly is entirely submersible, self-contained and easily cleaned and ready for re-use without the necessity of utilizing a plurality of relatively expensive filtering elements. This structure therefore eliminates the need of fluid interconnection to the permanent filtering system normally associated with in-ground swimming pools or spas and allows immediate return of the filtered water back into the area without passing through the aforementioned permanent filtering system associated with the pool or spa.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
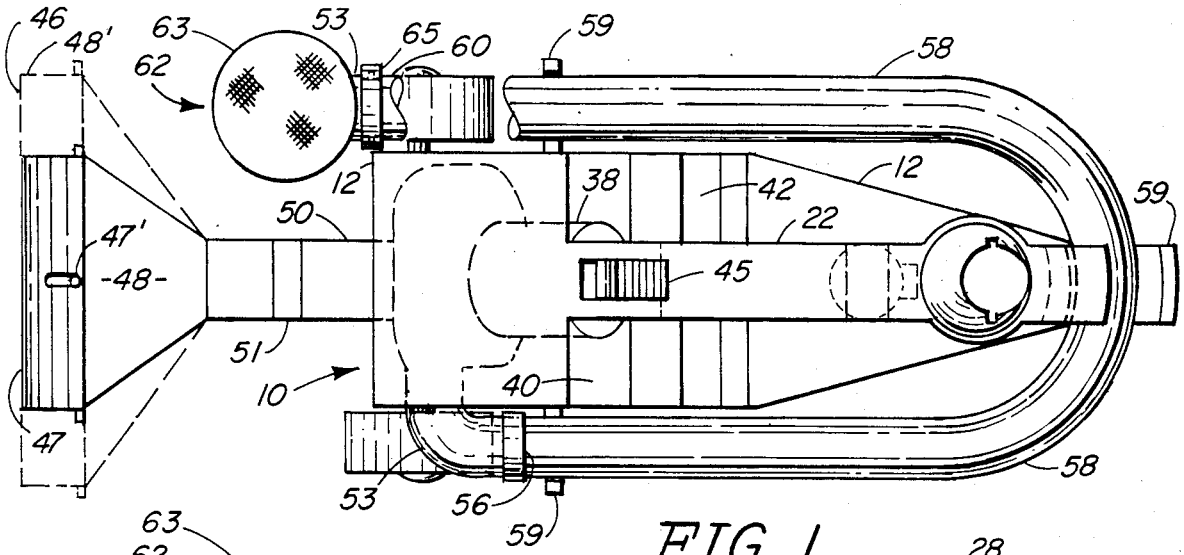
FIG. 1 is a top plan view of the cleaning assembly of the present invention.
Figure 2:
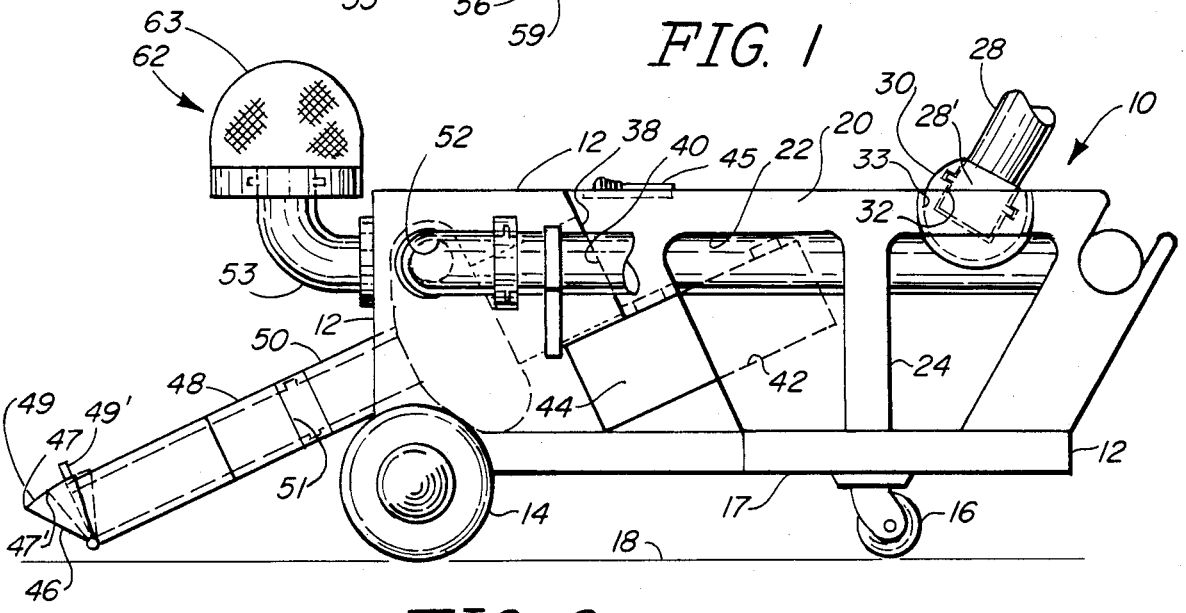
FIG. 2 is a side plan view of the embodiment of FIG. 1.
Figure 3:
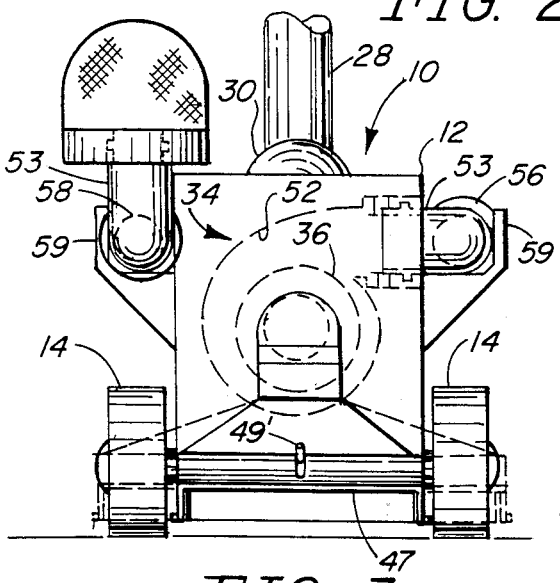
FIG. 3 is a front plan view of the embodiment of FIGS. 1 and 2.
Figure 4:
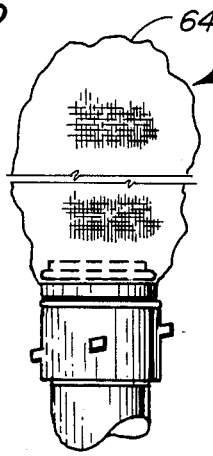
FIG. 4 is a detailed view in partial cutaway showing structural features of the filter component associated with the subject cleaning assembly.
Figure 5:
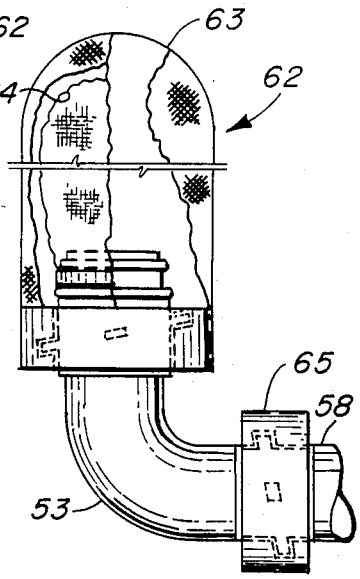
FIG. 5 is a detailed view in partial cutaway showing interior structural features of the filter assembly and a connection of the extremity thereof to an elongated filtering hose.

As shown in FIGS. 1 through 3, the cleaning assembly of the present invention is geneally indicated as 10 and includes a carriage 12 having a plurality of wheels 14 and 16 secured to the undersurface 17 of the carriage 12 so as to facilitate movement and maneuverability of the carriage 12 across a supporting surface 18. The supporting surface 18 is submerged and serves as a containment for a large body of water such as in a swimming pool or spa. The purpose of the assembly 10 of the present invention is to collect debris, dirt, etc. of the type normally collected on the submerged bottom surface and wall surfaces of swimming pools and spas. In one embodiment of the present invention, the front wheels 14 are weighted or made from a heavy material, such as lead or other metal coated with a protective covering. This weighting of the front wheels 14 is to insure that the carriage 12 sinks and effectively maintains contact with the surface 18 being cleaned. The weights incorporated into the wheels 14 should be sufficient to overcome any natural buoyancy of the carriage 12 but not be so great as to make the carriage 12 difficult to manage or maneuver.

Such maneuverability of the carriage 12 is accomplished by handle means including a first fixed handle 20 integrally attached or otherwise fixedly secured to the carriage and specifically dimensioned and configured to be at least partially apertured as at 22. This apertured construction allows the hand of the user to pass around the first handle portion 20 and thereby position and maneuver the carriage so as to collect the debris on the surfaces being cleaned as desired. The handle means of the present invention further includes a rotatable ball 30 and receiving socket 32 mounted without a carriage socket 33 in which the ball 30 is pivotally or rotatably mounted. The receiving socket 32 is specifically structured to receive the end 28' of an elongated pole 28 of sufficient length to position and maneuver the carriage 12 on the bottom of a swimming pool at relatively great depths.

An important feature of the present invention is the incorporation of a pump assembly generally indicated as 34 at least partially enclosed in a water tight configuration on the interior of carriage 12. More specifically, the pump assembly 34 includes a voluted impeller 36 rotatably driven by a drive motor 38 housed within a water tight housing or containment portion of carriage 12 as indicated at 40. Similarly, a power source in the form of a d.c. battery or like structure 44 is housed within a battery casing 42. The battery or power source is electrically interconnected to the drive motor 38 and thereby powers the drive motor to selectively rotate the impeller 36. An on/off switch 45 is disposed in current regulating relation between the battery 44 and the drive motor 38 so as to selectively operate the impeller causing forced flow of water and entrained debris into and out of the carriage.

The impeller 36 is disposed in fluid communication with the conduit means of the assembly 10. More specifically, the conduit means includes an inlet portion 50 extending in direct fluid communication with impeller 36 at its inner end and extending outwardly from the carriage into removable interconnection with an intake nozzle 48. A quick disconnect coupling 51 serves to allow easy removal of nozzle 48 and replacement thereof with one of a plurality of nozzles of varying size depending upon the particular application (swimming pool or spa) for which the cleaning assembly 10 is intended to be used. The nozzle 48 includes an inlet 46 designed to draw in fluid and entrain debris or dirt which passes eventually to the inlet portion 50 of the conduit and to the impeller 36 of the pump assembly 34.

One feature of nozzle 48 includes an adjustable inlet wherein leading edge 47 may have its angular orientation relative to supporting surface 18 varied such that a suction is applied directly to the debris before any other portion of the assembly can reach the debris and thereby possibly disturb it or force it out of the way of the inlet 46 as by disturbed water currents. In one embodiment of the present invention, an adjustable hood 49 may be positioned between the upmost position indicated by the leading edge 47 or a downwardly oriented more angled position closer to supporting surface 18 indicated by leading edge 47' in phantom lines. As shown in FIG. 2, a nozzle 48' having a larger inlet 46 may be utilized when a swimming pool as versus a spa is intended to be cleaned. A knob 49' is provided to position adjustable hood 49 into the various positions shown.

The conduit means of the present invention further includes an outlet portion 52 (see FIG. 1) wherein water and entrained debris is forced from the impeller 36 through the outlet portion 52 to an outwardly extending end 53 of outlet portion 52. End 53 removably engages a channeling conduit 58 as at end 56 thereof. Accordingly, the impeller serves to create a flow of forced fluid or water, with debris or dirt entrained therein, from the inlet 46 of the nozzle 48 through the inlet portion 52 of the conduit means to the impeller and therebeyond through outlet portion 52 and eventually into the channeling conduit 58 mounted on the exterior of the carriage. A downstream extremity of the conduit means is defined by the distal end 60 of the channeling conduit 58 wherein it is connected to a filter structure generally indicated as 62. The length of the channeling conduit 58 is such as to reduce the pressure or force of fluid flow as it reaches the filter structure 62 but yet allow the water to pass therethrough. The filter structure 62 includes a filter basket or holder 63 itself formed from a porous material which has sufficient rigidity to contain a filter cloth element 64 on the interior thereof. The porosity of the cloth filter element 64 is such as to retain any dirt or debris but allow flow of filtered water to pass therethrough and through the porous construction of the filter basket 63. A quick disconnect coupling 65 serves to interconnect the distal end 60 of channeling conduit 58 with the filter structure 62 such that the latter can be readily removed. Once removed, the cloth filter element can be cleaned and easily replaced thereby eliminating the need for expensive precisely sized replaceable filter elements.

Yet another embodiment of the present invention includes the channeling conduit 58 having an extremely long longitudinal dimension sufficient to allow the extremity thereof to be attached to the permanent or conventional skimmer basket associated with the pool. In such an embodiment, the pumped water is delivered directly to the skimmer basket wherein the debris is stopped or filtered from the pumped water which passes back into the pool system in the conventional fashion. In this embodiment, the filtering system per se of the pool structure, including conventional fan filters, etc., is not relied on to move the debris from the submerged surfaces of the pool since the debris will be caught in the skimmer basket.

In yet another embodiment, the conduit 58 may extend upwardly from its connection 56 at outlet 53 and be attached to pole 28 by a conventional connector. This position insures that filtered water will be directed away from the surface 18 being cleaned.

Accordingly, it can be seen that the underwater cleaning assembly 10 of the present invention is effectively self-contained in that it is self-powered and contains its own removable and replaceable filter structure such that water being filtered is returned directly to the body of water immediately after filtering, thereby eliminating the need for utilization of the pump and filter system permanently associated with the pool structure.

It is therefore to be understood that the following claims are intended to cover all of the generic and specific features of the present invention herein described, and all statements of the scope of the invention which as a matter of language, might be said to fall therebetween.

Now that the invention has been described, what is claimed is:

1. A self-contained cleaning assembly of the type used for underwater cleaning of swimming pools, spas, and like structures, said assembly comprising:

(a) a carriage structured for manual placement and movement over bottom and wall underwater surfaces and including a pump means mounted thereon, said pump means structured and disposed for forcing water and debris into a portion of said pump means, (b) said pump means including a drive motor being electrically powered and a portable electric power source connected thereto, both said drive motor and said power source mounted within a watertight housing, (c) said pump means further comprising an impeller rotatably connected in driven relation by said drive motor, said impeller disposed and structured to create a forced fluid flow into and out of said carriage structure, (d) conduit means mounted on said carriage structure for directing fluid therethrough and interconnected in fluid communication with said impeller and including an inlet portion and an outlet portion respectively disposed downstream and upstream of said impeller, (e) a filter structure connected to a downstream extremity of said conduit means and having a porous construction dimensioned to allow fluid flow and prohibit flow of debris therethrough, (f) said filter structure comprising a basket formed of material of sufficient porosity to allow fluid flow to pass therethrough, (g) said filter structure further comprising a flexible material cloth mounted in said basket and structured to include sufficient porosity to allow fluid flow to pass therethrough and capture debris therein, said filter cloth removably mounted within said basket and capable of being removed therefrom, washed, and replaced, and (h) handle means connected to said carriage and disposed for maneuvering of said carriage relative to said underwater surface being cleaned.

2. An assembly as in claim 1 wherein said conduit inlet portion and outlet portion are mounted at least in part on an interior of said carriage in direct fluid communication with said impeller, said impeller disposed between said inlet and outlet portions and structured to force fluid therebetween.

3. An assembly as in claim 1 wherein said conduit means further comprises a channeling conduit connected to said outlet conduit and extending outboard of said carriage, said channeling conduit structured and disposed to direct fluid flow from an interior of said carriage to said filter structure.

4. An assembly as in claim 3 wherein said downstream extremity of said conduit means is defined by a distal end of said channeling conduit, said filter structure removably connected to said distal end in interruptive and receiving relation to fluid flow and debris exiting said carriage.

5. An assembly as in claim 4 wherein said channeling conduit is of a length sufficient to reduce the force of fluid flow reaching said filter structure from said carriage.

6. An assembly as in claim 3 wherein said channeling conduit is removably attached to said outlet portion of said conduit means.

7. An assembly as in claim 3 further comprising bracket means for supporting said channeling conduit mounted on an exterior of said carriage and extending substantially along the length of said channeling conduit for removable securing of the latter to said carriage.

8. An assembly as in claim 1 wherein said handle means comprises a first handle fixedly mounted on said carriage and dimensioned and configured to be grasped by a human hand, whereby said carriage may be maneuvered on relatively small surface areas to be cleaned.

9. An assembly as in claim 8 wherein said handle means comprises a movably mounted receiving connector secured to said carriage and structured to receive an elongated pole structure of sufficient length to maneuver said carriage over relatively deep underwater surfaces.

10. An assembly as in claim 1 further including a plurality of wheels rotatably mounted on said carriage and disposed to extend outwardly therefrom into movably engaging relation with a surface being cleaned.

11. An assembly as in claim 10 wherein at least one of said plurality of wheels are weighted so as to counter buoyancy of said carriage and insure movable engagement of said carriage over a surface being cleaned.

12. A self-contained cleaning assembly of the type used for underwater cleaning of swimming pools, spas, and like structures, said assembly comprising:

(a) a carriage structured for manual placement and movement over bottom and wall underwater surfaces and including a pump means mounted thereon, said pump means structured and disposed for forcing water and debris into a portion of said pump means, (b) said pump means including a drive motor being electrically powered and a portable electric power source connected thereto, both said drive motor and said power source mounted within a watertight housing, (c) said pump means further comprising an impeller rotatably connected in driven relation by said drive motor, said impeller disposed and structured to create a forced fluid flow into and out of said carriage structure, (d) conduit means mounted on said carriage structure for directing fluid therethrough and interconnected in fluid communication with said impeller and including an inlet portion and an outlet portion respectively disposed downstream and upstream of said impeller, (e) a filter structure connected to a downstream extremity of said conduit means and having a porous construction dimensioned to allow fluid flow and prohibit flow of debris therethrough, (f) said filter structure further constructed to be cleaned and connected on said downstream extremity for repeated use, (g) handle means connected to said carriage and disposed for maneuvering of said carriage relative to said underwater surface being cleaned, and (h) a nozzle secured to a free end of said inlet conduit and including an entrance structured to include an outwardly extended angularly oriented spaced and overhanging disposition relative to the surface being cleaned and thereby disposed for inflow of fluid and debris therethrough.

13. An assembly as in claim 2 further comprising an adjustable end construction formed on a distal extremity of said nozzle and selectively positionable between a plurality of angular orientations relative to the surface being cleaned.

14. An assembly as in claim 12 wherein said nozzle is removably connected to said free end of said outlet portion and replaceable thereon with any one of a plurality of nozzles of varying dimension and configuration.

15. A self-contained cleaning assembly of the type used for underwater cleaning of swimming pools, spas, and like structures, said assembly comprising:

(a) a carriage structured for manual placement and movement over bottom and wall underwater surfaces and including a pump means mounted thereon, said pump means structured and disposed for forcing water and debris into a portion of said pump means, (b) said pump means including a drive motor being electrically powered and a portable electric power source connected thereto, both said drive motor and said power source mounted within a watertight housing, (c) said pump means further comprising an impeller rotatably connected in driven relation by said drive motor, said impeller disposed and structured to create a forced fluid flow into and out of said carriage structure, (d) conduit means mounted on said carriage structure for directing fluid therethrough and interconnected in fluid communication with said impeller and including an inlet portion and an outlet portion respectively disposed downstream and upstream of said impeller, (e) a filter structure connected to a downstream extremity of said conduit means and having a porous construction dimensioned to allow fluid flow and prohibit flow of debris therethrough, (f) said filter structure further constructed to be cleaned and connected on said downstream extremity for repeated use, (g) handle means connected to said carriage and comprising a movably mounted receiving connector on said carriage and structured to receive an elongated pole of sufficient length to maneuver said carriage over relatively deep underwater surfaces to be cleaned, and said connector comprising a ball and socket structure configured for removable attachment to said pole structure and said ball rotatably mounted within said socket to facilitate maneuvering of said carriage.

* * * * *